US010603900B2

(12) United States Patent
Fehlner et al.

(10) Patent No.: US 10,603,900 B2
(45) Date of Patent: Mar. 31, 2020

(54) METHOD FOR DETECTING A DEFECTIVE PRINT NOZZLE USING A VARIABLE PRINT NOZZLE TEST PATTERN

(71) Applicant: HEIDELBERGER DRUCKMASCHINEN AG, Heidelberg (DE)

(72) Inventors: Andreas Fehlner, Mannheim (DE); Thomas Wolf, Heidelberg (DE); Andreas Henn, Neckargemuend (DE); Steffen Neeb, Bensheim (DE); Nicklas Raymond Norrick, Heddesheim (DE); Jens Forche, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/191,508

(22) Filed: Nov. 15, 2018

(65) Prior Publication Data

US 2019/0152219 A1 May 23, 2019

(30) Foreign Application Priority Data

Nov. 22, 2017 (DE) ..... 10 2017 220 843

(51) Int. Cl.
*B41J 2/045* (2006.01)
*B41J 2/21* (2006.01)
*B41J 25/00* (2006.01)

(52) U.S. Cl.
CPC ..... *B41J 2/0451* (2013.01); *B41J 2/04586* (2013.01); *B41J 2/2142* (2013.01); *B41J 2/2146* (2013.01); *B41J 2025/008* (2013.01)

(58) Field of Classification Search
CPC .... B41J 2/0451; B41J 2/04586; B41J 2/2146; B41J 2/2142; B41J 2025/008
See application file for complete search history.

(56) References Cited

U.S. PATENT DOCUMENTS

| | | | | |
|---|---|---|---|---|
| 7,327,503 | B2 | 2/2008 | Yashima et al. | |
| 2010/0165022 | A1* | 7/2010 | Makuta | B41J 2/04508 347/9 |
| 2013/0100187 | A1* | 4/2013 | Yasuzaki | B41J 2/16517 347/9 |
| 2014/0002525 | A1 | 1/2014 | Takeishi et al. | |
| 2018/0086081 | A1 | 3/2018 | Sakamoto | |

FOREIGN PATENT DOCUMENTS

DE 60209287 T2 11/2006

* cited by examiner

*Primary Examiner* — Bradley W Thies
(74) *Attorney, Agent, or Firm* — Laurence A. Greenberg; Werner H. Stemer; Ralph E. Locher

(57) ABSTRACT

A method detects defective print nozzles in an inkjet printing machine by a computer. In a first phase within the context of a print job, print nozzle test patterns are printed beside a subject on a printing substrate. These print nozzle test patterns are then digitized by an image sensor and sent to the computer, where they are analyzed by the computer to determine the current state of the print nozzles, including defective print nozzles. After the first phase, the print nozzle test patterns are modified by the computer on the basis of the current state of the print nozzles and, in a second phase, the modified print nozzle test patterns are printed, digitized and evaluated by the computer with regard to the determination of the current state of the print nozzles and defective print nozzles.

11 Claims, 4 Drawing Sheets

METHOD FOR DETECTING A DEFECTIVE PRINT NOZZLE USING A VARIABLE PRINT NOZZLE TEST PATTERN

CROSS-REFERENCE TO RELATED APPLICATION

This application claims the priority, under 35 U.S.C. § 119, of German application DE 10 2017 220 843.0, filed Nov. 22, 2017; the prior application is herewith incorporated by reference in its entirety.

BACKGROUND OF THE INVENTION

Field of the Invention

The invention relates to a method for the detection of defective print nozzles in an inkjet printing machine by means of the use of dynamic print nozzle test patterns.

The invention lies in the technical field of inkjet printing.

During the operation of inkjet printing machines, in particular in large industrial format, the question of the printing quality is always also a question of the serviceability of the individual print nozzles of the inkjet print heads used. The individual print nozzles can decline in their serviceability as far as complete failure. This is caused by the penetration of foreign bodies, for example grains of dust, or by the drying out of remaining ink, in particular if the inkjet print head is not used for a relatively long time. Both fault sources lead to the openings of the print nozzles being partly or even entirely blocked, so that the envisaged quantity of ink in the form of expelled ink droplets can no longer be expelled from the relevant print nozzle. In the event of a partially blocked or blocked print nozzle, the deviation of the printed dot in the form of a so-called obliquely spraying print nozzle is also possible. These faults in the serviceability of the print nozzles lead to artifacts in the printed image produced, such as "white lines" in the case of failed print nozzles, or, in the case of obliquely spraying print nozzles, to "white lines" instead of the actual printed dot from the relevant print nozzle and a "black line" produced by an increased application of ink at the point in the printed image where the obliquely spraying print nozzle then contributes erroneously to the ink application. Such faulty print nozzles, which cause such image artifacts in the form of "white lines" and "black lines", are also designated overall as "missing nozzles".

In order to be able to continue to use the relevant inkjet print head when such "missing nozzles" occur and not continually to have to perform costly replacement of the inkjet print heads, the prior art discloses a multiplicity of compensation methods for faulty print nozzles. These compensation strategies include, among other things, the provision of redundant print nozzles and print heads for the same printing ink but also, in the case of multicolor printing, the substitution of "missing nozzles" by print nozzles of other printing inks which print in the same position in the printed image as the "missing nozzle". A further approach consists in adapting the printed image before the screening with the knowledge of faulty print nozzles, specifically such that the "missing nozzles" cause as few artifacts as possible in the subsequent printed image. The adaptations can comprise both adaptation of the gray values in the digital printed image for the region which is subsequently depicted by the "missing nozzles" after the screening, and also the shifting of entire image objects in the digital printed image by means of appropriately adapted imposition.

However, the most common approach consists in adapting the screened printing image in the knowledge of faulty print nozzles such that the inkjet printing machine is activated in such a way that print nozzles adjacent to the "missing nozzle" expel more ink in order thereby to compensate the faulty print nozzle.

However, in order to compensate faulty print nozzles, these must first be detected. An extremely wide range of detection methods for this purpose are also known from the prior art. These can be divided up roughly into two different approaches. The first approach consists in detecting the printed image continuously by means of an image capture system having at least one image sensor, digitizing the printed image and supplying it to a computer, which then evaluates the digital images and examines the same with regard to possible "missing nozzles". The computer then supplies the results of its evaluation to the responsible authority for the compensation of the "missing nozzles" that have occurred. The disadvantage with this approach is that faulty print nozzles often cannot be detected by an evaluation of the printed images to be printed directly in the continuous printing process of the printing machine, since the nozzles are, for example, not involved in the printing of the current printed image. In addition, the printing data to be produced in the actual printed image is seldom suitable to detect faulty print nozzles optimally.

A further approach to the detection of faulty print nozzles therefore consists in printing print nozzle test patterns individually optimized for the detection of faulty print nozzles onto the printing substrate in addition to the printed image actually to be produced, and having the same evaluated via the aforementioned image capture system. The disadvantage with this method is that it is always necessary to produce additional image data on the substrate, which means that the performance and the loading of the inkjet printing machine are increased. When printing print nozzle test patterns, small image objects, for example short vertical strokes, are usually printed by each print nozzle and are then examined in the context of the detection method by the evaluation computer of the image capture system, wherein, by using the quality of the image object produced by the individual print nozzle, conclusions about its serviceability can be drawn. For this evaluation, there are limiting values which define the point at which a print nozzle is to be estimated as faulty or until when it still counts as serviceable. Depending on these characteristic values, a decision about switching off or again switching on a print nozzle is made. Furthermore, it must be noted that the detection pattern takes up a certain amount of area on a printed sheet or in a label section and must be printed individually for each color.

There are approaches which divide up the print nozzle test patterns into individual test fields, in order to minimize the area needed per sheet or per label section. The consequence is that a greater time interval elapses between the detections of a print nozzle, and therefore the measurement interval is prolonged.

The reaction to local accumulations of defective or unstable print nozzles and print heads is neither nozzle-specific nor print-head-specific nor subject-dependent in the printing process. This means that, irrespective of whether the characteristic values of some print nozzles fluctuate more or less highly, the test fields for parameter determination are printed equally frequently.

Problematic print head regions are distinguished by the fact that these contain print nozzles which have a volatile quality behavior over the course of the printing. This means that it is possible only with great difficulty to predict how the print nozzles will react during the next ink discharge, and the print nozzles classified as defective will change from print to print.

This leads to the print nozzle characteristic values in the poor print nozzles more rapidly being no longer up-to-date and erroneous values being assumed. This necessarily leads to more wastage and qualitatively poor printed products.

The question is, therefore, how good printing quality is to be achieved in continuous printing, permanently set in the inkjet print. The current compensation strategy based on the detection methods known from the prior art fails in continuous printing. The reason for this, as investigations show, is that defective print nozzles are either statically/permanently useless or fail dynamically under load in printing operation. For a functioning compensation strategy, it is therefore also necessary to detect and to estimate defective print nozzles dynamically. In this case, print nozzle test patterns are printed and evaluated nozzle-specifically and/or classified as good/poor. It is possible to observe that, in the case of poor print heads, amongst other things more print nozzles exhibit striking behavior, e.g. lie outside the accepted crookedness tolerance threshold, and the characteristic values of print nozzles change highly from one detection to the next.

It is therefore necessary for different approaches to be developed as to how these findings obtained could be used directly on the printing machine for quality improvement in continuous operation. And, if no adequate quality can be achieved, how this information could be fed back and how it is necessary to react, e.g. which print heads must be cleaned or even replaced.

SUMMARY OF THE INVENTION

The object of the present invention is, therefore, to find a method for the detection of defective print nozzles in an inkjet printing machine which identifies faulty print nozzles more quickly and more efficiently than the detection methods known from the prior art.

This object is achieved by a method for the detection of defective print nozzles in an inkjet printing machine by means of a computer wherein, in a first phase within the context of a print job, print nozzle test patterns are printed beside a subject on a printing substrate. The print nozzle test patterns are then digitized by means of at least one image sensor and sent to the computer, where they are analyzed by the computer in order, on this basis, to determine the current state of the print nozzles, including defective print nozzles, and which is characterized in that, after the first phase, the print nozzle test patterns are modified by the computer on the basis of the current state of the print nozzles and, in a second phase, the modified print nozzle test patterns are printed, digitized and evaluated by the computer with regard to the determination of the current state of the print nozzles and defective print nozzles.

The critical point of the method according to the invention therefore consists in establishing once in the first place what the current state of the print nozzles of the inkjet print heads of the inkjet printing machine is. For this purpose, in a way similar to that previously already known from the prior art, an appropriately selected print nozzle test pattern is printed, is digitized by means of at least one image sensor of the image capture system and is sent to the computer, which evaluates additional data and accordingly draws conclusions about the current serviceability of print nozzles involved in the printing. The computer corresponds to the evaluation computer of the image capture system. Since it has just been shown that a static print nozzle test pattern on print nozzles changing correspondingly in their serviceability cannot be used optimally to assess their serviceability, in a second phase, the print nozzle test pattern or patterns used is/are then modified such that print nozzles affected by problems detected in the first phase, which are either faulty print nozzles or can possibly develop into such, are checked more frequently or checked in more detail than other less critical regions. For this purpose, it is important to understand that, in the first phase, which corresponds to the previous prior art, it is not always the complete print nozzle test pattern for all the color separations of the current print job that is produced beside the actual printed image to be produced, but instead always in the coarsest breakdown a test pattern for one color separation. In addition, a further subdivision is possible, for example such that only part of the corresponding print nozzle test pattern is produced for the respective color separation in one pass. In the next copy of the printed image to be produced, the next part of the relevant print nozzle test pattern or the version for the next color separation is then appropriately printed. The print nozzle test patterns are therefore divided up accordingly over the individual copies of the printed image to be produced, since they otherwise would take up too large a proportion of the printed subject, and thus impair the performance of the printing machine too much. The second phase according to the invention now consists of, so to speak, making use of these restrictions and not always continuously printing the individual print nozzle test pattern components in the same proportions, but in adapting the proportions such that critical regions are preferably printed with print nozzle test patterns adapted thereto and are thus checked more frequently. Therefore, critical print nozzles or print nozzle regions can be checked better and faulty print nozzles detected more quickly.

Advantageous and therefore preferred developments of the method can be gathered from the associated sub-claims and from the description and the associated drawings.

A preferred development of the method according to the invention is that the print nozzle test pattern is printed such that it consists of a specific number of horizontal rows of periodically vertically printed, equally spaced lines which are arranged under one another, wherein, in each row of the nozzle test pattern, the print nozzles of the print head of the inkjet printing machine which correspond to the specific number of horizontal rows each contribute only periodically to the first element of the nozzle test pattern. Many types of print nozzle test patterns are known. One particularly suitable variant consists of a specific number of horizontal rows with vertically printed, equally spaced lines. Since the resolution of the at least one image sensor with the technology currently used is normally considerably lower than the resolution of the actually produced printed image, it is not possible for all the adjacent print nozzles also to be printed directly beside one another, since the at least one image sensor does not have the necessary resolution to keep said individual lines apart. Therefore, for example, only each tenth vertical line from its corresponding print nozzle is printed in a horizontal row. In order to cover all the print nozzles and to arrange for their vertical lines to be printed, the print nozzle test pattern therefore consists of a total of ten horizontal rows.

A further preferred development of the method according to the invention is that the print nozzle test pattern is modified by the computer on the basis of the current state of the print nozzles in such a way that print nozzles which are defective or whose current state is critical for printing quality to be produced are preferably involved in printing the modified print nozzle test pattern in the second phase. The already explained division of the print nozzle test pattern to be produced in the second phase is carried out, according to the invention, in such a way that print nozzles or regions of print nozzles which have a critical state are preferably printed, i.e. more frequently than other less critical regions, and these print nozzles are thus checked more frequently than other print nozzles.

A further preferred development of the method according to the invention is that the print nozzles preferably involved in printing the modified print nozzle test pattern are divided up into regions of print nozzles in such a way that the regions contain individual print nozzles which are volatile in their produced print quality and/or are individual print heads having such volatile print nozzles and/or specific nozzle regions with such volatile print nozzles, wherein these regions are then allocated specific modified print nozzle test patterns. The division into specific regions of print nozzles is done in such a way that either individual print nozzles are combined into regions, or regions of adjacent print nozzles in which critical print nozzles accumulate are declared as a region or make up a region equal to a correspondingly critical entire print head having such critical volatile print nozzles. The division into individual print heads makes sense in particular as the area provided for the individual part of the print nozzle test pattern to be printed always makes up the entire printed image width in any case and of course it makes no sense to print only individual small regions in the space available for the respective print nozzle test pattern and to leave the other regions unprinted. Thus, for example, the print nozzle test patterns to be modified are divided in such a way that specific print nozzle test patterns are printed only for those horizontal rows of the print nozzle test pattern which comprise the particularly critical print nozzles. Alternatively, specific print nozzle test patterns are printed for those color separations which are printed by the particularly critical print heads. Limits are placed on the division and corresponding modification of the test patterns that are available, only to the extent that the region which is provided for the print nozzle test pattern on the subject is limited and by the number of versions of the print nozzle test patterns that are available.

A further preferred development of the method according to the invention is that a critical parameter for the type of modification of the print nozzle test patterns for the divided regions of print nozzles is the total state of the respective divided region. It is likewise practical to use it as an important decision parameter in the second phase as to how the print nozzle test pattern modifies the total of the respective divided region. The condition of the individual print nozzles is therefore combined such that a total for the respective region results. In the question as to which characteristic values are then included in the parameter of the total, for example the failure probability is recommended. The background is that, within the context of assessing the serviceability of the print nozzles, not only is the current state detected but also the future development of the serviceability of the print nozzles is calculated in a predictive manner in the form of the characteristic value of the failure probability for this print nozzle. If, for example, the failure probability of all the individual print nozzles of the divided region is combined to form a total failure probability for this region, the latter can be used as a critical characteristic variable for the parameters of the total of the divided region.

A further preferred development of the method according to the invention is that the modification of the print nozzle test patterns by the computer consists in preferentially printing specific print nozzle test patterns and/or parts of specific print nozzle test patterns which, in the first phase, have proven to be particularly effective for assessing the current state of the print nozzles. Of course, it is particularly advantageous, when dividing up the print nozzle test patterns for critical regions with correspondingly critical individual print nozzles, not always to print the same print nozzle test pattern again but in particular preferably to use and thus to print more frequently those print nozzle test patterns which have proven to be particularly suitable for the assessment of critical print nozzles. Particularly effectively thus means that those test patterns are to be preferred which, on account of the nature of the image object produced thereby, e.g. the vertical stroke by the individual print nozzle, particularly well permits an assessment and thus conclusions about the serviceability of the print nozzle printing this image object. Thus, for example, the image object of a vertical stroke in a test pattern is very well suited to determine the measure of the crookedness with which the relevant print nozzle prints. Print nozzle test patterns which, for example, consist of points and not of vertical lines, are considerably less suitable for this purpose.

A further preferred development of the method according to the invention is that, for the assessment of the current state of the print nozzles by the computer, characteristic values such as the thickness, the crookedness and the color of the vertically printed, equally spaced lines, and the utilization of the print nozzles involved, are used. The corresponding characteristic values, by means of which the current serviceability of the tested print nozzles is to be assessed, are, amongst others, the aforementioned thickness, crookedness and color of the vertically printed lines. Of course, these characteristic values also apply to the case in which other types of print nozzle test patterns are used. In this case, however, the characteristic values would possibly have to be adapted to the other shape of the individual image objects which are printed by the print nozzles in the test pattern. It is also important that the utilization of the print nozzles involved is also included as a characteristic value, since the serviceability of the individual print nozzles is also particularly dependent on the level of the utilization thereof. The necessity of the use of dynamic print nozzle test patterns, as disclosed by this invention, certainly results precisely from the fact that the serviceability of the individual print nozzles depends in particular on their utilization and is thus just not static but dynamic.

A further preferred development of the method according to the invention is that the inkjet printing machine is a sheet-fed inkjet printing machine, which prints printing sheets as printing substrate, and the modified print nozzle test patterns are allocated individually to the individual regions of print nozzles, depending on the current state of the print nozzles, and are distributed to the individual printing sheets. The method according to the invention can of course be used for all the specific types of inkjet printing machines. A particularly preferred area of use is, however, sheet-fed inkjet printing machines. In this case, the division of the print nozzle test patterns into the individual image objects is carried out in such a way that one or more divided regions of the print nozzle test patterns are distributed to the individual printing sheets.

A further preferred development of the method according to the invention is that the modified print nozzle test patterns of the second phase are stored in a database by the computer together with parameters from the print job. Although the modified print nozzle test patterns of the second phase depend specifically on the current state of the print nozzles, which in turn depends directly on the current print job, nevertheless this does not rule out subsequent re-use of the modified print nozzle test patterns produced in this way. They are therefore stored in a database that can be reached by the computer, together with the parameters of the print job. The corresponding characteristic values which describe the state of the print nozzles, and also the parameter of the total, which has just led to this corresponding modification of the print nozzle test pattern as a further characteristic value, are also stored.

A further preferred development of the method according to the invention is that, in the first phase, already modified print nozzle test patterns are printed, wherein these are taken from the database and are selected for the current print job by using suitable parameters from the print job. If, then, a new print job is selected, which selects similar printed images and a comparable printing machine, those already modified print nozzle test patterns are preferably selected from the database, by using the parameters of the print job which would supposedly lead to similar characteristic values for the state of the print nozzles to those of the selected modified print nozzle test pattern. Alternatively, use can also be made of the stored characteristic values in order, on this basis, to calculate the modified print nozzle test pattern. The use of already modified print nozzle test patterns as early as in the first phase is particularly expedient if the same printing machine is used again for a similar print job in a short space of time. Of course, this does not relate to those modified print nozzle test patterns which are specified for specific individually selected regions of critical print nozzles if the parameters of the print job are completely different. In the aforementioned scenario, that the same printing machine is used again for a similar print job, these adapted print nozzle test patterns can be very helpful, however, since it is improbable that the criticality of individual print nozzles will change completely within an extremely short time in the same printing machine.

Other features which are considered as characteristic for the invention are set forth in the appended claims.

Although the invention is illustrated and described herein as embodied in a variable print nozzle test pattern, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
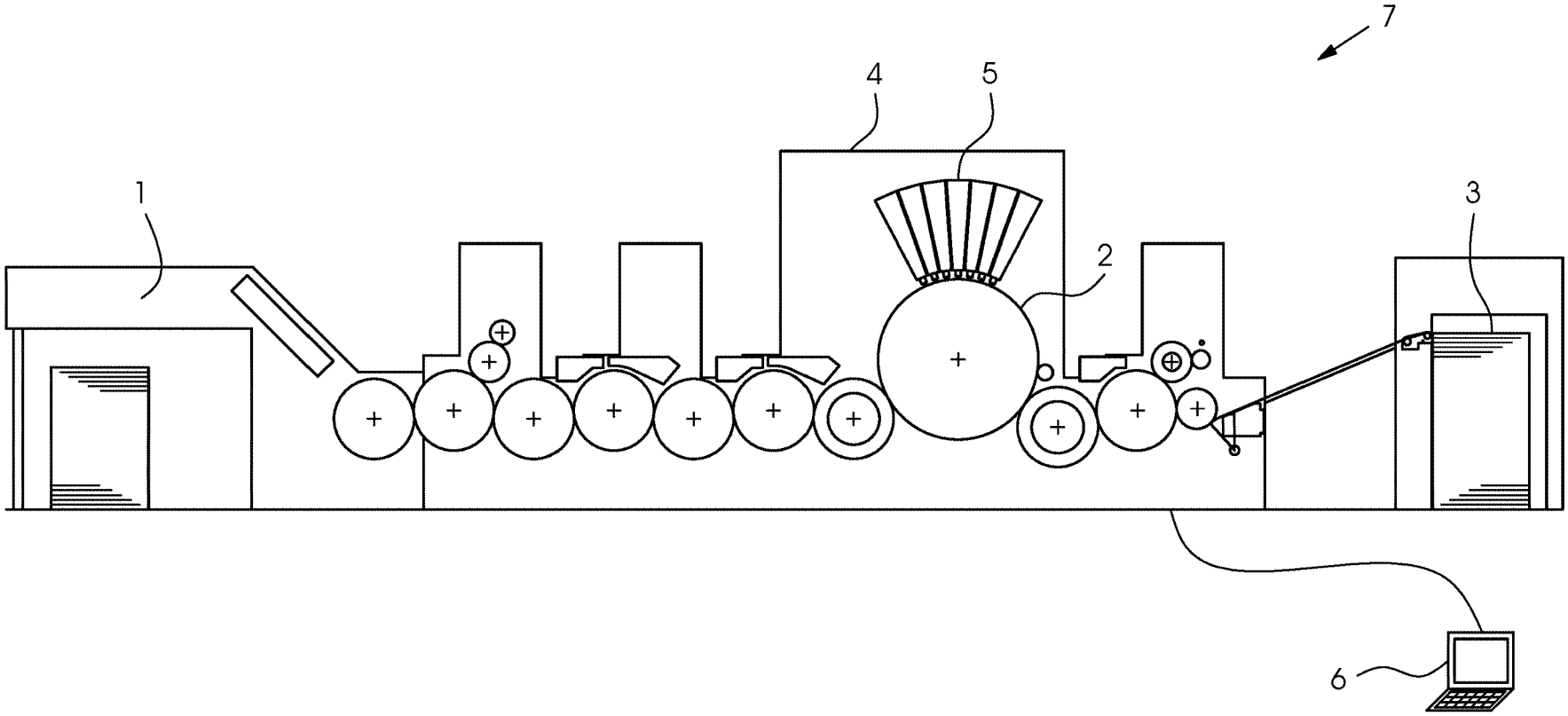
FIG. 1 is a diagrammatic, side view of an example of a sheet-fed inkjet printing machine.

Referring now to the figures of the drawings in detail and first, particularly to FIG. 1 thereof, there is shown an area of application of preferred design variants being an inkjet cutting machine 7. An example of the basic structure of such a machine 7, contains a feeder 1 for the supply of a printing substrate 2 into a printing unit 4, where it is printed by print heads 5, as far as a deliverer 3, is illustrated in FIG. 1. Here, this is a sheet-fed inkjet printing machine 7, which is monitored by a control computer 6.

Figure 2:
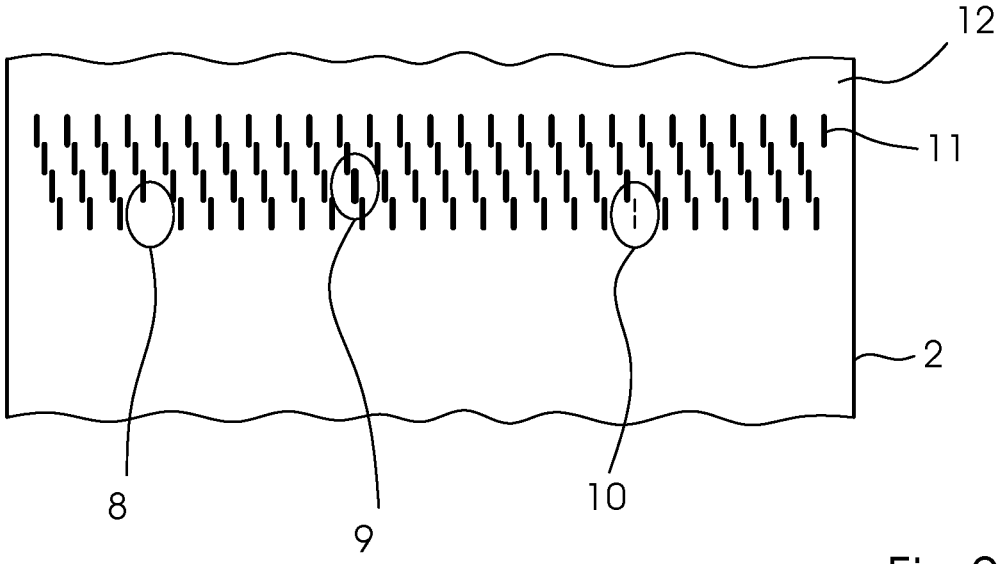
FIG. 2 is an illustration of a printed example of a print nozzle test pattern having horizontal rows consisting of vertically equally spaced lines.
Figure 3A:
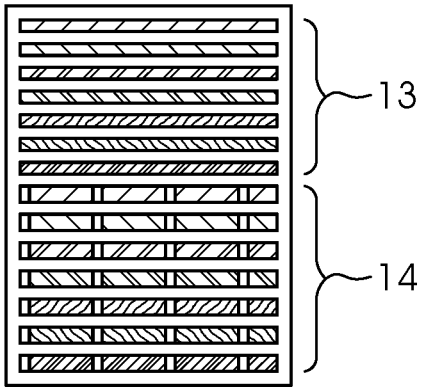
FIG. 3A is an illustration of a selection of two different print nozzle test patterns distributed to all the process colors CMYK+special colors OGV.
Figure 3B:
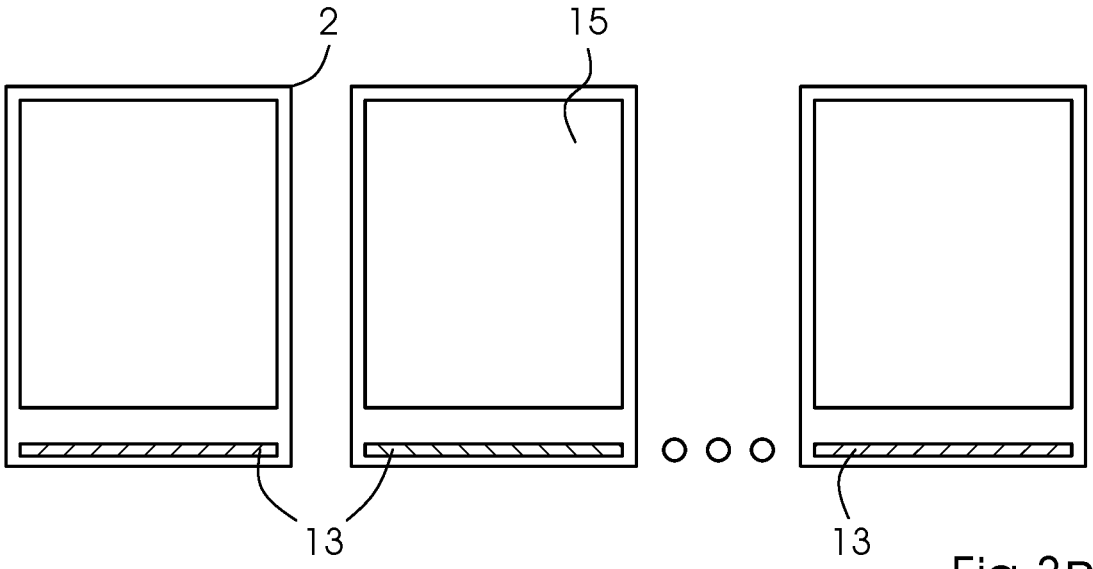
FIG. 3B is an illustration of a division of individual components of the print nozzle test pattern in phase 1.
Figure 3C:
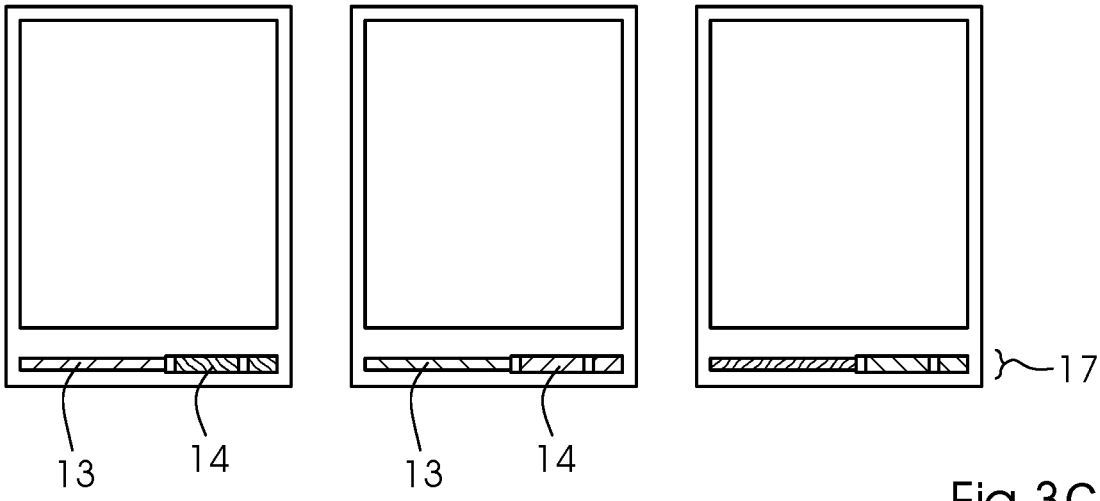
FIG. 3C is an illustration of the division of the print nozzle test patterns modified in accordance with the invention in phase 2.
Figure 4:
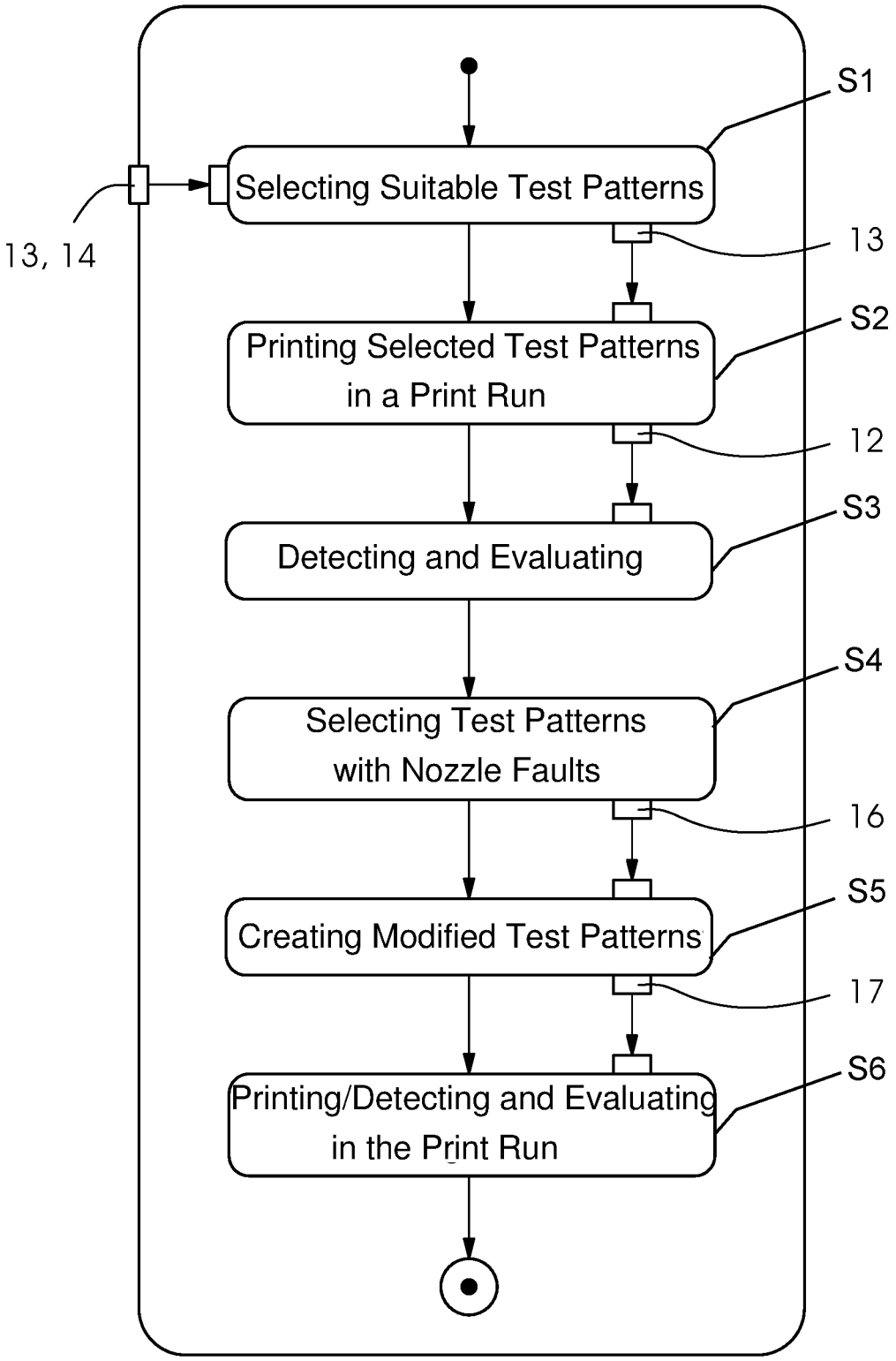
FIG. 4 is a flow chart illustrating a sequence of a method according to the invention.

FIG. 4 shows in simplified form the sequence of the method according to the invention in a preferred design variant. First, in a first phase of the method, step S1, one or more suitable print nozzle test patterns 13, 14 are chosen for the current print job. One example of such a test pattern 12 in its printed form can be seen in FIG. 2, wherein only each $x^{th}$ print nozzle produces a test image object in the form of a vertical stroke 11 in a horizontal line, for which purpose x horizontal lines per print nozzle test pattern 17 must then accordingly be printed in order that each print nozzle produces at least one vertical stroke 11. Also to be seen well here are image objects 11, that is to say vertical strokes 11, which have been printed by defective print nozzles, such as, for example, by failed print nozzles 8, differently printing print nozzles 9 and reduced-printing print nozzles 10. In FIG. 3A, in turn, an exemplary set of two print nozzle test patterns 13, 14 for a seven-color print with CMYK and OGV is illustrated. In the next step S2, the selected test pattern or patterns 13, 14 are distributed to the individual printing sheets 2, so that an appropriate part of the selected print nozzle test pattern 13, 14 is printed under each printed image 15 to be produced, above or below the printed image 15. This can be seen well in FIG. 3B for the example having the two print nozzle test patterns 13, 14 with CMYK and OGV. These are then captured digitally by the image capture system and digitized. The captured and digitized print nozzle test patterns 16 are then evaluated by the evaluation computer 6 of the image capture system with regard to possible faulty print nozzles 8, 9, 10 and/or the current state of the print nozzles, steps S3 and S4. Once the current serviceability of the print nozzles involved in the printing has been completed in this way, the second phase begins, in which the computer 6 modifies the previously divided print nozzle test patterns 13, 14 with regard to individual regions or individual print nozzles which count as critical in the current state, step S5. One example of the result of the modified, divided print nozzle test pattern 17 for the aforementioned example can be seen in FIG. 3C. It is easy to see how individual print nozzle test patterns 13, 14 known from FIG. 3*a* have been divided up individually to the individual regions in such a way that each region having individual critical print nozzles 8, 9, 10 is captured by the print nozzle test pattern 13, 14 that is particularly suitable for the capture and assessment of the serviceability of these print nozzles 8, 9, 10. These test patterns 17, which depend on the constitution of the individual print nozzles, therefore comprise individually assembled parts of the print nozzle test patterns 13, 14 that are available. They are then distributed appropriately to the individual printing sheets 2, placed below or above the appropriate image object 15 to be printed. Printing is then carried out again, and the print nozzle test pattern 17 is again captured by the image capture system, and the current constitution of the individual print nozzles is assessed, step S6. The modification of the print nozzle test pattern 17 to be printed takes place "on-the-fly" during the actual continuous printing for the processing of the print job. The print nozzle test patterns 17 are modified continuously in the second phase, wherein it is recommended to define individual intervals at which the print nozzle test patterns 17 just used are updated. Finally, first a certain amount of data about the current state of the print nozzles involved in the printing must be collected before a realistic reassessment of the current state is possible. By using these print nozzle test patterns 17 matched to the current state of the print nozzles involved, optimal detection of faulty print nozzles 8, 9, 10 is then always possible, and/or an optimal assessment of the current state of the print nozzles involved in the printing.

The execution of the method according to the invention in its preferred design variant will be discussed in somewhat more detail below. In order to obtain a statement about the quality of individual print nozzles, the quality or constitution, in the form of characteristic values such as the thickness of a line, crooked spray value, that is to say the deviation from the intended position and the gray value, of each individual print nozzle over time must be known. For this purpose, the suitable print nozzle test patterns 13, 14 are printed, evaluated in line by the machine control system and stored together with a time stamp. Simultaneous capture of the characteristic values of all the print nozzles of all the colors in a printing sheet 2 is not necessary; instead a detection pattern 13, 14 is distributed to several printing sheets.

Initialization is carried out, with one or preferably more printing sheets 2 which contain the corresponding print nozzle test patterns 13, 14 for all colors and print heads 5. During continuous printing, the print nozzle test patterns 13, 14 are repeated such that the print nozzles which suggest a quality-critical behavior or are mainly checked. The print nozzle test pattern can also contain several colors. Thus, in FIG. 3B, a complete print nozzle test pattern 13, 14 for one color for the first phase of the method according to the invention is shown.

The invention provides for the frequency of the printing of the individual print nozzle test patterns 13, 14 to be made dependent on the constitution of the individual print nozzles.

If, then, during the print run a rule infringement is established which states that specific print nozzles have a quality-critical behavior, these regions are, for example, printed more frequently and regions of non-critical print nozzles less frequently. To this end, the print nozzle test patterns 13, 14 can be divided up differently than has previously been known from the prior art—for example by dividing up by using print heads 5 or smaller nozzle units. In this way, nozzle characteristic value test elements of different colors and therefore resultant parts of different print nozzle test patterns 13, 14 are distributed such that they land on a printing sheet 2 as a modified print nozzle test pattern 17.

A further, preferred design variant consists in adapting the frequency for the printing of each individual test element, such as in the form of the print nozzle test pattern 13, 14 or a gray area, individually and for each sheet 2 or label section.

Another suitable approach in order to determine the frequency with which the respective print nozzle test patterns 17 of the respective distributed nozzle unit is to be printed is represented by the respective total constitution of the divided up nozzle units. This can be represented by the probability of failure. If, for example, the probability of failure of each individual print nozzle is known by means of previous or simultaneous determinations, this total constitution can be expressed as a total probability of failure of the nozzle unit. An objective decision as to which nozzle unit is to be monitored in which interval is therefore possible.

The following is a summary list of reference numerals and the corresponding structure used in the above description of the invention:

1 Feeder
2 Printing substrate
3 Deliverer
4 Inkjet printing unit
5 Inkjet print head
6 Computer
7 Inkjet printing machine
8 Test image object printed by failed print nozzle
9 Test image object printed by crookedly printing print nozzle
10 Test image object printed by reduced-printing print nozzle
11 Test image object
12 Printed print nozzle test pattern
13 First print nozzle test pattern in CMYKOGV color separations
14 Second print nozzle test pattern in CMYKOGV color separations
15 Printed image to be produced
16 Selected captured print nozzle test pattern with faulty print nozzles
17 Created dependent print nozzle test pattern

The invention claimed is:

1. A method for detecting defective print nozzles in an inkjet printing machine by means of a computer, which comprises the steps of:

printing, in a first phase within a context of a print job, first print nozzle test patterns below or above a printed image on a printing substrate;

digitizing the first print nozzle test patterns by at least one image sensor;

sending the digitized print nozzle test patterns to the computer, and analyzing the digitized print nozzle test patterns by the computer to determine a current state of print nozzles, including an existence of the defective print nozzles;

after the first phase, modifying the first print nozzle test patterns by the computer on a basis of the determined current state of the print nozzles to form modified print nozzle test patterns from the first print nozzle test patterns;

printing, in a second phase, the modified print nozzle test patterns;

digitizing the modified print nozzle test patterns; and evaluating the digitized modified print nozzle test patterns by the computer with regard to a determination of the current state of the print nozzles and of the defective print nozzles.

2. The method according to claim 1, which further comprises printing the print nozzle test patterns such that the print nozzle test patterns contain a specific number of horizontal rows of periodically vertically printed, equally spaced lines which are disposed under one another, wherein, in each row of the print nozzle test patterns, the print nozzles of a print head of the inkjet printing machine which correspond to the specific number of horizontal rows each contribute only periodically to a first element of the print nozzle test patterns.

3. The method according to claim 2, wherein for an assessment of the current state of the print nozzles by the computer, at least one characteristic value selected from the group consisting of thickness, crookedness and color of the vertically printed, equally spaced lines, and a utilization of the print nozzles involved, is used.

4. The method according to claim 1, which further comprises modifying the print nozzle test patterns by the computer, depending on the current state of the print nozzles, in such a way that the print nozzles which are defective or whose current state is critical for printing quality to be produced are involved in printing the modified print nozzle test patterns in the second phase.

5. The method according to claim 4, which further comprises dividing up the print nozzles involved in printing the modified print nozzle test patterns into regions of print nozzles in such a way that the regions contain individual print nozzles which are volatile in a produced print quality and/or are individual print heads having such volatile print nozzles and/or specific nozzle regions with the volatile print nozzles, wherein the regions are then allocated the modified print nozzle test patterns.

6. The method according to claim 5, wherein a critical parameter for a type of modification of the first print nozzle test patterns for divided up regions of the print nozzles is a total state of a respective divided region.

7. The method according to claim 5, wherein a modification of the first print nozzle test patterns by the computer includes preferentially printing specific print nozzle test patterns and/or parts of specific print nozzle test patterns which, in the first phase, have proven to be particularly effective for assessing the current state of the print nozzles.

8. The method according to claim 5, wherein the inkjet printing machine is a sheet-fed inkjet printing machine which prints printing sheets as the printing substrate, and the modified print nozzle test patterns are allocated individually to individual regions of the print nozzles, depending on the current state of the print nozzles, and are distributed to individual ones of the printing sheets.

9. The method according to claim 1, which further comprises storing the modified print nozzle test patterns of the second phase in a database by the computer together with parameters of the print job.

10. The method according to claim 9, which further comprises in the first phase, printing the modified print nozzle test patterns, wherein the modified print nozzle test patterns are taken from the database and are selected for a current print job by using suitable parameters of the print job.

11. A method for detecting defective print nozzles in an inkjet printing machine by means of a computer, which comprises the steps of:

printing, in a first phase within a context of a print job, parts of a print nozzle test patterns below or above a printed image on a printing substrate;

digitizing the parts of the print nozzle test patterns by means of at least one image sensor;

sending digitized print nozzle test patterns to the computer where the digitized parts of the print nozzle test patterns are analyzed by the computer to determine a current state of print nozzles, including an existence of the defective print nozzles;

after the first phase, modifying the parts of the print nozzle test patterns by the computer on a basis of the current state of the print nozzles, so that the print nozzles that are defective or whose current state is critical for printing quality to be produced are involved in printing the modified parts of the print nozzle test patterns in a second phase, and by dividing up the print nozzles involved in printing the parts of the modified print nozzle test patterns into regions of print nozzles such that the regions contain individual print nozzles that are volatile in a produced print quality and/or are individual print heads having volatile print nozzles and/or specific nozzle regions with the volatile print nozzles, wherein the regions are then allocated to the parts of the modified print nozzle test pattern;

printing, in the second phase, modified parts of the print nozzle test patterns;

digitizing the parts of the modified print nozzle test patterns; and evaluating digitized parts of the modified print nozzle test patterns by the computer with regard to a determination of the current state of the print nozzles and of the defective print nozzles.

* * * * *